US006945606B2

(12) United States Patent
Ponticelli

(10) Patent No.: US 6,945,606 B2
(45) Date of Patent: Sep. 20, 2005

(54) CHAIR

(76) Inventor: Pius Ponticelli, Hohenstrasse Ost 673, CH-4616 Kappel (CH)

( * ) Notice: Subject to any disclaimer, the term of this patent is extended or adjusted under 35 U.S.C. 154(b) by 0 days.

(21) Appl. No.: 10/488,145

(22) PCT Filed: Aug. 23, 2002

(86) PCT No.: PCT/EP02/09447

§ 371 (c)(1),
(2), (4) Date: Sep. 22, 2004

(87) PCT Pub. No.: WO03/020078

PCT Pub. Date: Mar. 13, 2003

(65) Prior Publication Data

US 2005/0029850 A1 Feb. 10, 2005

(30) Foreign Application Priority Data

Aug. 30, 2001 (DE) ..... 101 42 081

(51) Int. Cl.[7] ..... A47C 3/20
(52) U.S. Cl. ..... 297/337; 297/338
(58) Field of Search ..... 297/337, 338

(56) References Cited

U.S. PATENT DOCUMENTS 4,148,523 A * 4/1979 Brand et al. ..... 297/338 X
4,240,663 A * 12/1980 Locher ..... 297/338 X
4,738,487 A * 4/1988 Shalinsky et al. ..... 297/338
4,793,654 A * 12/1988 Takafuji ..... 297/338
5,167,436 A * 12/1992 Wu ..... 297/338
5,328,240 A * 7/1994 Neumuller ..... 297/338
5,511,855 A * 4/1996 Miles ..... 297/338 X
5,609,390 A * 3/1997 Takafuji ..... 297/338 X
5,702,158 A * 12/1997 Mengshoel et al. ..... 297/338 X
5,868,469 A * 2/1999 Ming ..... 297/338
5,887,947 A * 3/1999 Chi ..... 297/337
6,017,089 A * 1/2000 Mengshoel ..... 297/338
6,318,801 B1 * 11/2001 Tkafuji ..... 297/338
6,752,460 B2 * 6/2004 Looser ..... 297/338

FOREIGN PATENT DOCUMENTS

EP 589834 A1 * 3/1994 ..... 297/338

* cited by examiner

*Primary Examiner*—Rodney B. White
(74) *Attorney, Agent, or Firm*—Bachman & LaPointe, P.C.

(57) ABSTRACT

A chair with at least one foot, a support profile, on which a seat and optionally a backrest is arranged, whereby the seat is continuously adjustable for height on the support profile. The seat is thus securely locked at a desired height by a height lock.

8 Claims, 6 Drawing Sheets

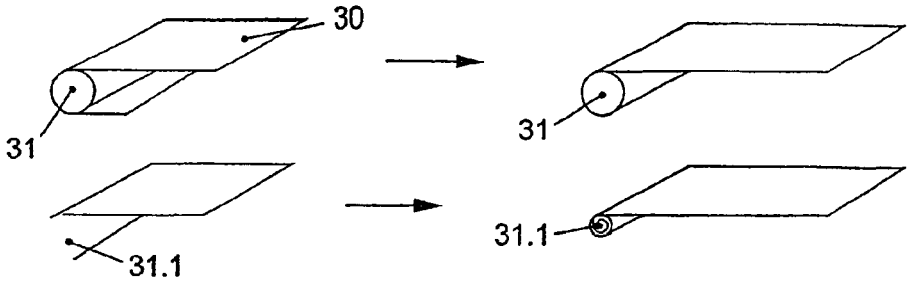
Fig. 8
Fig. 9
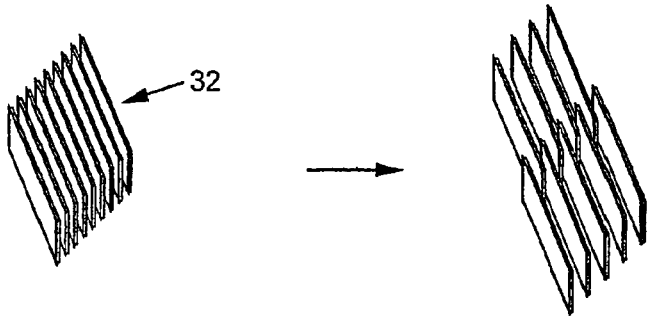
Fig. 10
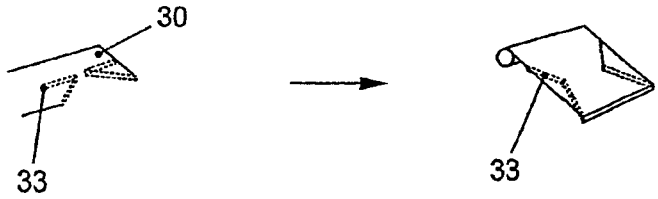
Fig. 11
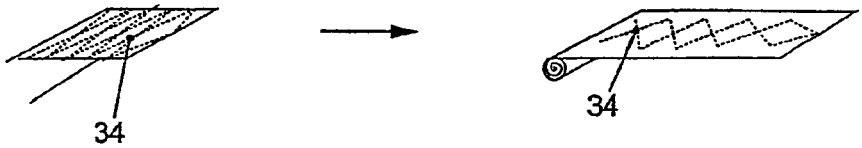
Fig. 12
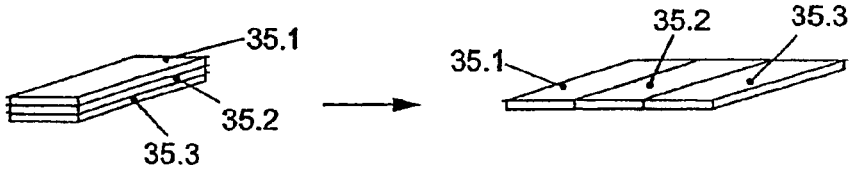
Fig. 13
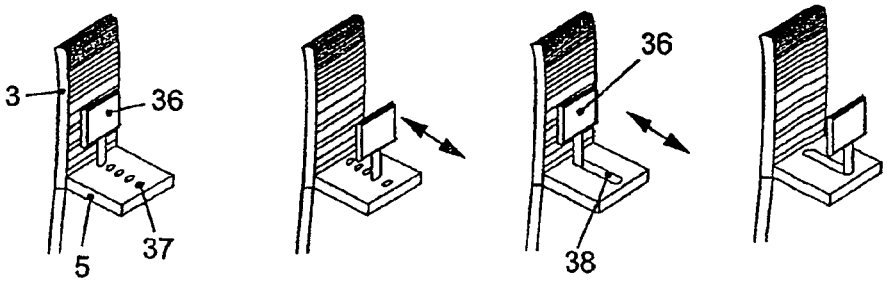
Fig. 14

CHAIR

BACKGROUND OF THE INVENTION

The invention relates to a chair having at least one foot and a support profile, on which a seat and, if appropriate, a backrest is arranged, it being possible for the seat to be adjusted in a stepless manner in height on the support profile and to be fixed in a secured manner at a desired height by a height-securing means, a connecting element being provided between the support profile and seat, and the seat being mounted in an articulated manner in relation to the connecting element.

Chairs are available in a wide variety of different shapes and forms. The present invention is concerned specifically with a chair for which it is possible to set the seat height and/or seat depth. The invention is also concerned with a chair which is collapsible.

U.S. Pat. No. 4,148,523, for example, discloses a chair of which the seat can be adjusted in height along a support profile. For adjustment purposes, the seat is raised, a connecting element is displaced along the support profile and the seat is then lowered again, in which case it subjects the support profile to a clamping action.

This chair has the disadvantage that if, for example, the seat is raised accidentally, the height is easily adjusted of its own accord. The clamping action of the seat in relation to the support profile depends essentially on the pressure to which the seat is subjected.

In order to avoid accidental displacement of the seat height, height-securing means are provided on the seat. It is likewise the case that such height-securing means are known and commonly used in a wide variety of different shapes and forms.

For example, EP 1 020 138 A1 describes a seat in which height and depth adjustment takes place by means of a toothed engagement strip, which runs on a chair framework, and a retaining device, which is assigned to the seat and on which a gearwheel, which meshes with the toothed engagement strip, is seated and drive means, which can be driven in rotation by the gearwheel, are arranged.

In order for it to be possible, then, to fix the seat at a certain height, the retaining device is assigned a clamping device, which clamps the retaining device firmly on the chair framework.

A further height-securing means is described in DE 195 19 739 A1. Here, a seat is connected to a support element via a screw and via a supporting arm. The supporting arm engages in a slot in the support element and, following release of a fastening means, can be displaced vertically in order then to be fixed again by means of the fastening means.

WO 99/00038 describes a further chair, which likewise has a height-adjustable and depth-adjustable seat panel which is assigned a support element. A height-securing means is produced here by the interengagement of noses on the support element with grooves in guide rails in side elements of the chair and of the support element itself with grooves of a gearwheel-like element on the rear side of the chair, clamping elements ensuring that the seat is fixed.

U.S. Pat. No. 6,017,089 discloses a chair of the above-mentioned type, the seat of which has a frame which is assigned a clamping device. This clamping device comprises frictional elements, which are assigned to the frame of the seat via pins. When the seat frame is rotated in the direction of a horizontal position, the frictional elements come into frictional contact between the support profiles of the chair, as a result of which a clamping action is produced. This clamping action is secured by a push-in pin.

The disadvantage with the above-described height-securing means, however, is that they are mostly connected directly to the seat or else to the support profile of the seat. This gives rise to a complicated construction for the height-adjusting means and thus also for the height-securing means, which results, in turn, in more difficult handling.

Furthermore, in the case of some of the above-mentioned height-securing means, the action of securing the seat at the desired height is insufficient since they rely merely on a clamping action between the seat and support profile. Furthermore, the height-securing means do not operate automatically.

Added to this is the fact that, in particular if use is made of, for example, screw-like elements, the screw-like element may jam in the support profile or the like, which may result, inter alia, in possible injury to the user.

The object of the present invention is thus to develop a chair of the above-mentioned type which is provided with a height-securing means which is highly variable in terms both of its settings and its handling, is easy to operate and, nevertheless, provides a sufficient securing action against the seat being adjusted out of its desired height.

SUMMARY OF THE INVENTION

The foregoing object is achieved in that the seat is mounted in an articulated manner in the vicinity of its top side and, in the use position, presses onto the support profile by way of a rear covering, the height-securing means having an adjusting catch on the connecting element, an edge of the seat engaging behind it in this use position.

By means of the arrangement, a covering which is present on the seat support is pressed against the support profile, as a result of which the position of the seat support is secured.

By virtue of the height-securing means being fitted on a connecting element, its handling is simplified to a considerable extent. All that is required is for the seat to be moved to its desired height. It is then possible for the height-securing means on the connecting element on the support profile to be moved into the corresponding position beneath the seat and fixed.

In another exemplary embodiment, the height-securing means has at least one clamping element which is guided in a guide slot such that, as soon as the seat or seat support has reached its desired height, the clamping element exerts a clamping action preferably in conjunction with the support profile, which avoids the situation where the seat is moved out of position without the clamping element being released.

In a further exemplary embodiment, it is even conceivable to provide two clamping elements, the second clamping element preventing the seat from being raised.

A further feature of the invention, concerns the support profile being fixed in an articulated manner on at least one foot.

This means that a collapsible chair is produced.

For this purpose, it is possible to fix, for example, on the foot a bearing link plate which is connected to the support profile in an articulated manner via an articulation pin. At the same time, the bearing link plate also forms a stop for the support profile as soon as the latter is in the use position.

The use position is secured by a latching catch, which engages in the support profile by way of a latching nose. This takes place under the pressure of a spring, with the result that it is only when this pressure is eliminated that the latching catch is released and the support profile is thus freed.

Yet a further idea of the present invention, confirms the adjustability of the seat depth. It is conceivable, in principle, for the seat depth to be of adjustable configuration. This can be achieved, in one instance, in that an appropriate, for example textile, seat surface is rolled up and can be unrolled as desired from, for example, a roller.

The seat depth is preferably increased and decreased under the action of a telescopic element. This could be, for example, a lamellar pull-out mechanism, at least one toggle lever or a scissors element.

In another exemplary embodiment, it is conceivable to form the seat surface from a plurality of parts, in which case the parts are drawn apart from one another, and supplemented by new parts, as desired. It is also the case here that the present invention should not be subject to limitations.

A particular idea of the invention, concerns the arrangement of an additional backrest, the adjustment of which can likewise change the seat depth.

Of course, it is conceivable for all the independent features also to be realized in one chair. This results in the production of a chair which is highly variable in respect of its settings. Furthermore, it can easily be collapsed and transported.

BRIEF DESCRIPTION OF THE DRAWINGS

Further advantages, features and details of the invention can be gathered from the following description of preferred exemplary embodiments, and with reference to the drawing, in which:

FIGS. 8–13 show perspective views of exemplary embodiments of seat surfaces with a changeable depth; and FIG. 14 shows perspective views of possible ways of achieving backrest adjustment.

DETAILED DESCRIPTION

Figure 1:
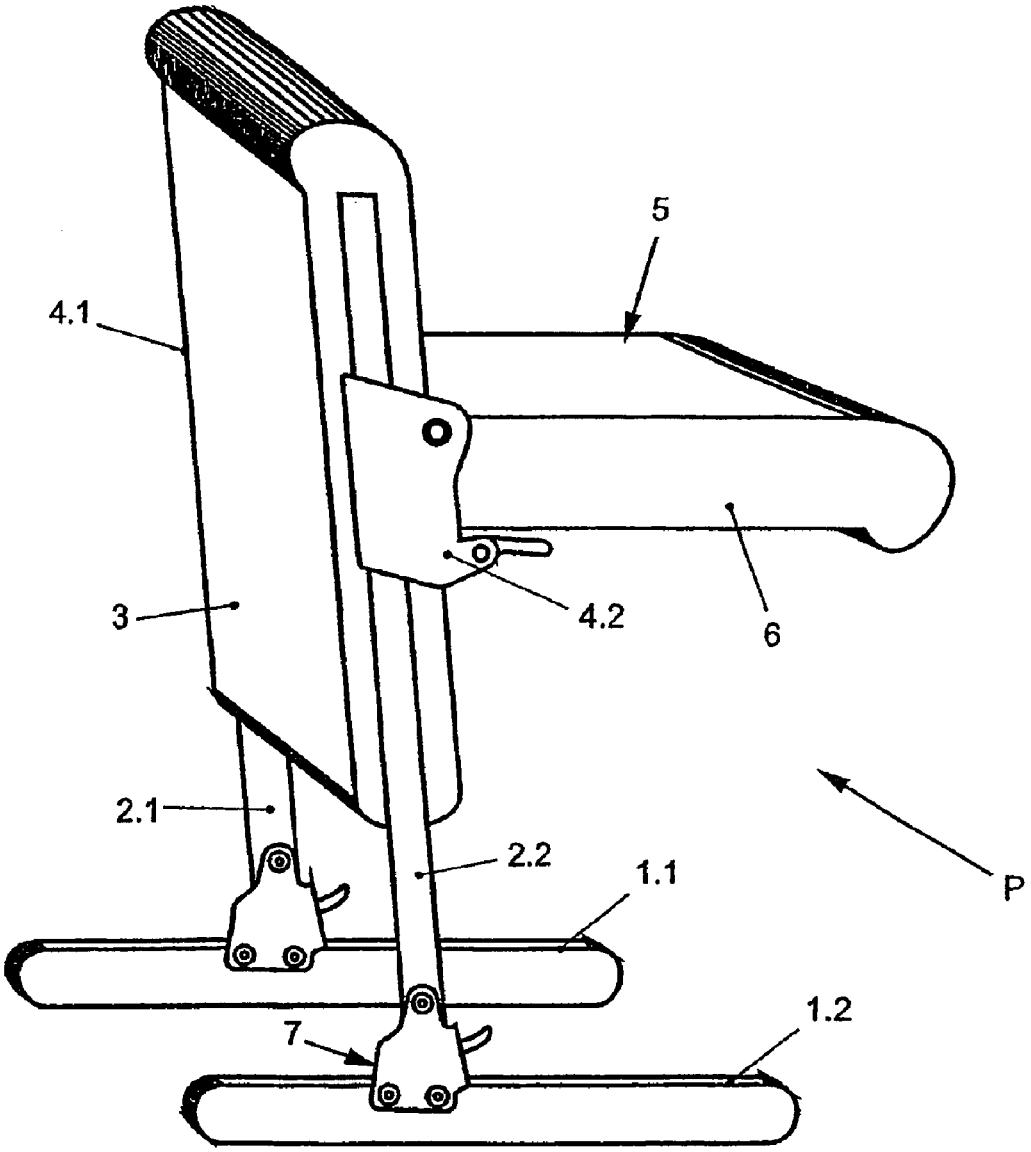
FIG. 1 shows a perspective view of a chair according to the invention.

According to FIG. 1, a chair P according to the invention has two feet 1.1. and 1.2, which are each connected to a support profile 2.1 and 2.2. The support profiles 2.1 and 2.2 accommodate a backrest 3 between them.

A seat 5 is connected to the support profiles 2.1 and 2.2 via a respective connecting element 4.1, 4.2. This connection takes place, if appropriate, via corresponding seat supports 6.

Figure 2:
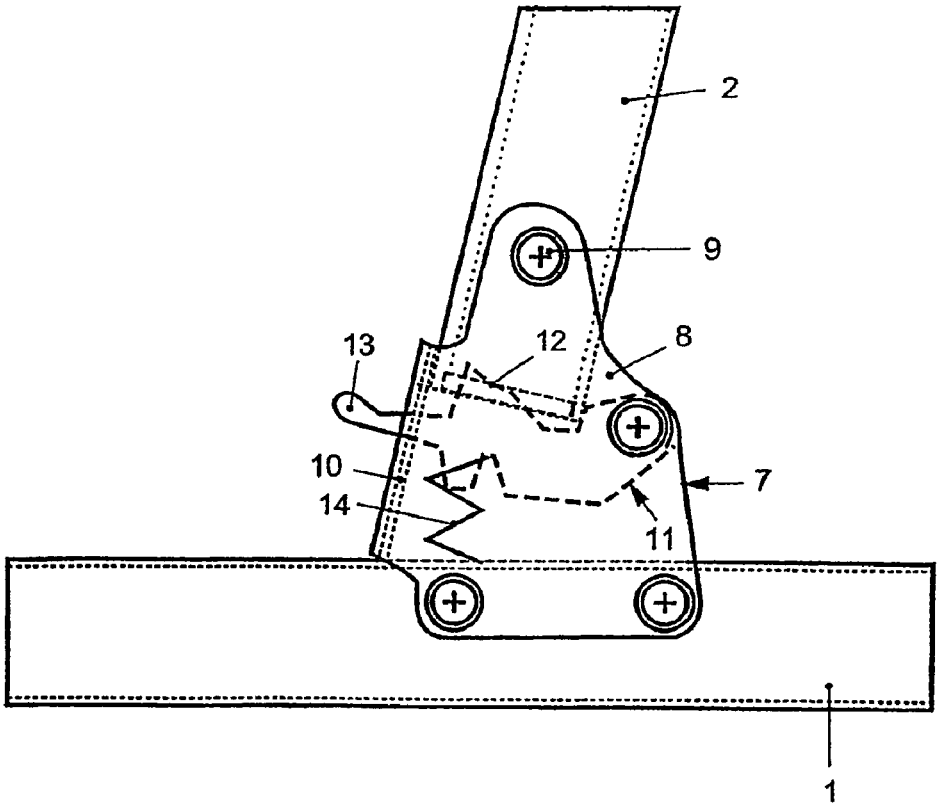
FIG. 2 shows a side view of a detail of the chair according to FIG. 1 in the region of the connection between the support profile and foot.
Figure 3:
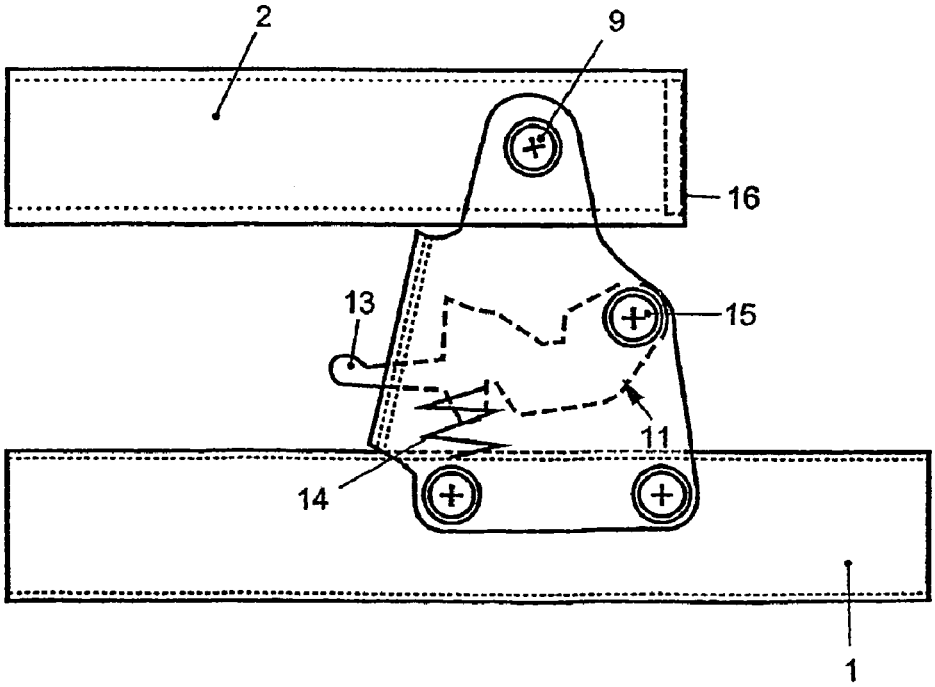
FIG. 3 shows a detail of the chair corresponding to FIG. 2, but in another use position.
Figure 4:
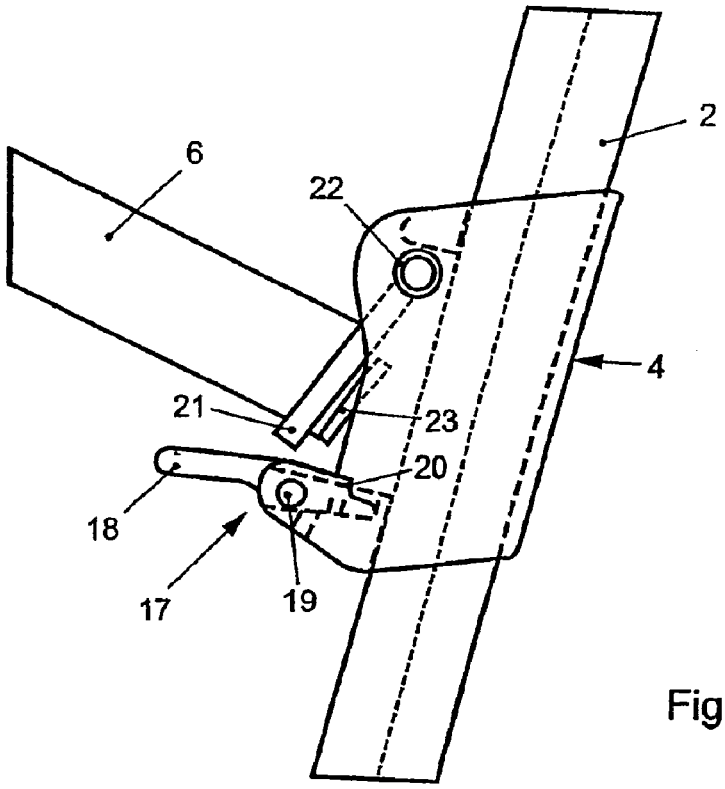
FIG. 4 shows a detail of the chair according to FIG. 1 in the region of the connection between a seat and a support profile.
Figure 5:
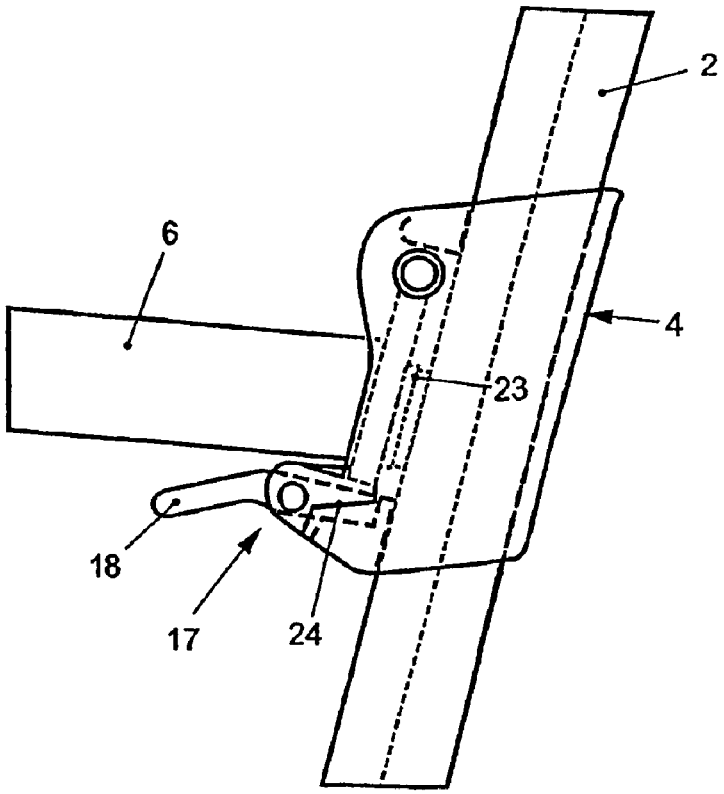
FIG. 5 shows the detail according to FIG. 4 in another use position.
Figure 6:
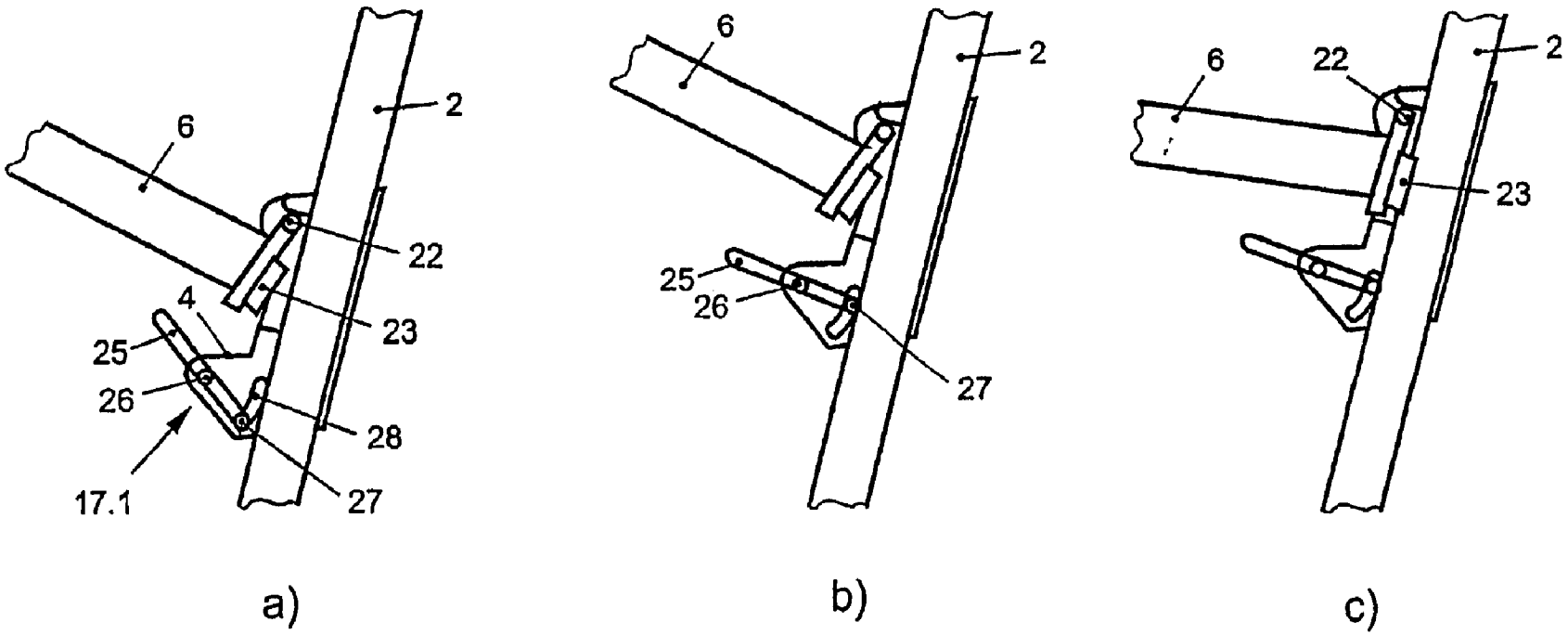
FIG. 6 shows a further exemplary embodiment of a detail of the chair according to FIG. 1 similar to FIGS. 4 and 5, in different use positions.

It can be seen in FIGS. 2 and 3 that a support profile 2 is connected to a foot 1 via an articulated connection 7. In this case, the articulated connection 7 preferably has two bearing link plates 8 arranged one behind the other, the bearing link plates 8 being connected to the support profile 2 via an articulation pin 9. The support profile 2 can rotate about the articulation pin 9.

The rotary movement of the support profile 2 in relation to the bearing link plate 8, however, is limited by an angled portion 10, which forms a stop for the support profile 2.

Provided between the two bearing link plates 8 is a latching catch 11 which, in the use position according to FIG. 2, engages in the support profile 2 by way of a latching nose 12 and fixes this support profile in the use position.

The latching nose 12 can be disengaged from the support profile 2 by a lever 13 being subjected to pressure, the latching catch 11 thus being moved out of the latching position counter to the pressure of a spring 14, as is shown in FIG. 3. In this case, the latching catch 11 rotates about a pin 15.

For latching-in purposes, the support profile 2 is pivoted about the articulation pin 9, in which case a control edge 16 slides onto the latching catch 11 and passes beyond the latching nose 12 until the latching nose moves into the support profile 2 under the pressure of the spring 14.

According to FIGS. 4–7, it is intended for it to be possible for the seat 5 or its seat supports 6 to be displaced along the support profile 2 and fixed at a desired height. For this purpose, the connecting element 4 is assigned a height-securing means 17. This height-securing means 17 has an adjusting catch 18, which is mounted in the connecting element 4 such that it can be pivoted about a pivot pin 19.

The adjusting catch 18 has a latching edge 20, which interacts with an edge 21 on the seat support 6.

The seat support 6 is arranged on the connecting element 4 such that it can be pivoted about a further pivot pin 22. The pivot pin 22 here is arranged such that the surface area of a covering 23 assigned to the seat support 6 butts against the support profile 2 in the seating position of the seat support 6 (FIG. 5), in which case, at the same time, the edge 21 has passed beyond the latching edge 20 of the adjusting catch 18 and the adjusting catch 18 has engaged over the edge 21 under the pressure of a spring 24. As a result, on the one hand, the covering 23 is pressed onto the surface of the support profile 2 and, on the other hand, it is retained in this position by the adjusting catch 18, with the result that displacement of the connecting element 4 along the support profile 2 is only possible once the adjusting catch 18 has been released.

FIGS. 6*a* to 6*c* shows a further exemplary embodiment of a height-securing means 17.1. This height-securing means 17.1 has a pivot lever 25 which is coupled to the connecting element 4 such that it can be rotated about a swivel pin 26. This pivot lever 25 can be used to move a clamping roller 27 in a guide slot 28. The guide slot 28 is of curved design, and the support profile 2 projects some way into its inside width.

With the clamping roller 27 released according to FIG. 6*a*, the connecting element 4 can be moved along the support profile 2. If the desired height for the seat has been reached, the pivot lever 25 is rotated about the swivel pin 26, with the result that the clamping roller 27 passes into the region of the support profile 2. This achieves a clamping action between the guide slot 28, clamping roller 27 and support profile 2, as is indicated in FIG. 6*b*.

If the seat support 6 is then pivoted about its pivot pin 22, as is shown in FIG. 6*c*, then the covering 23 comes into contact with the support profile 2, in which case, if desired, the covering 23 can also be positioned in relation to the surface of the support profile 2 such that the connecting element 4 is offset slightly in the downward direction. Consequently, the clamping roller 27 is drawn yet further into the clamping region between the guide slot 28 and surface of the support profile 2, with the result that secured fixing takes place.

Figure 7:
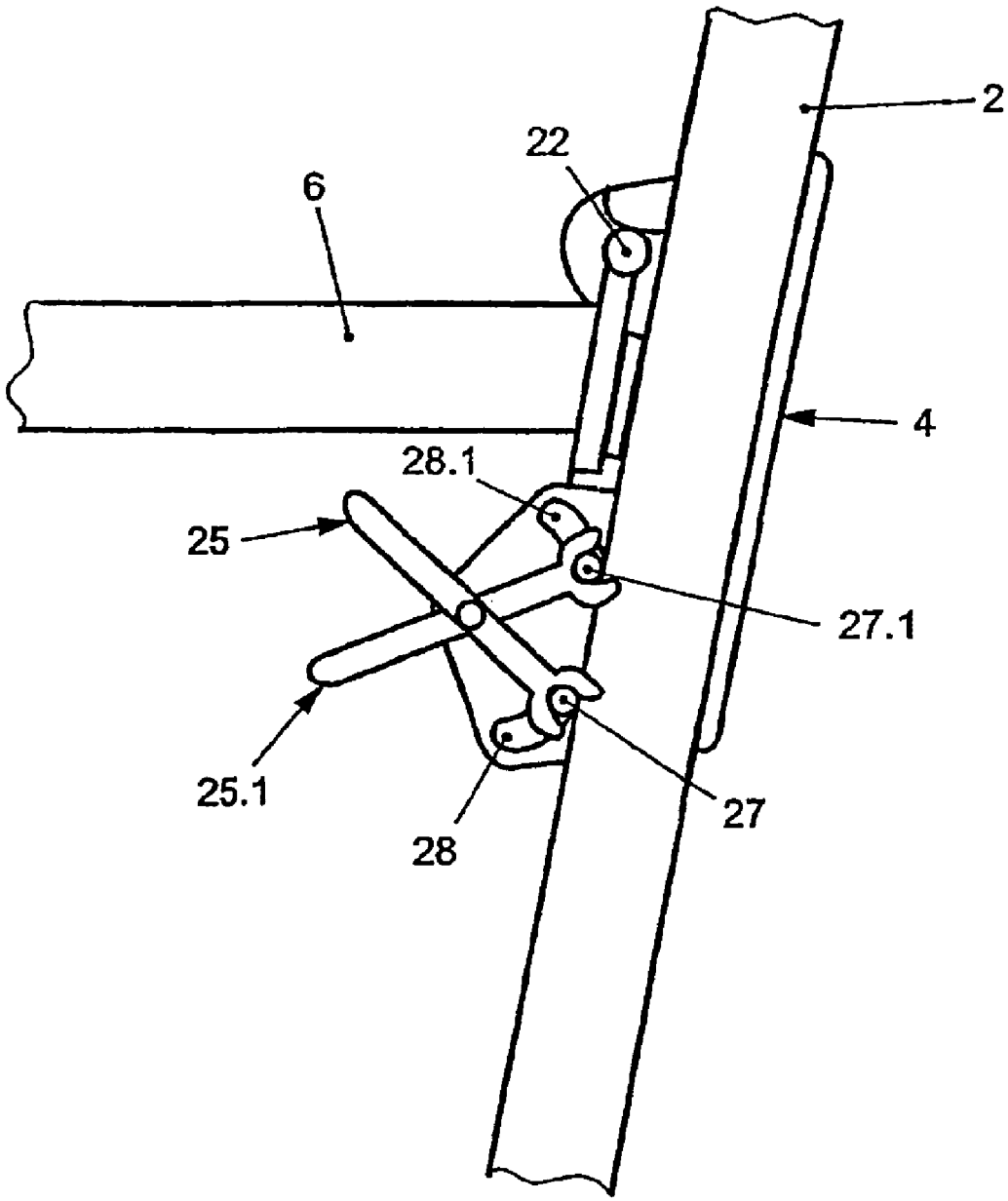
FIG. 7 shows a detail of a further exemplary embodiment of the chair according to FIG. 1 similar to FIG. 6.

According to the exemplary embodiment of FIG. 7, two pivot levers 25 and 25.1 are to be provided on the connecting element 4. Both are assigned a guide slot 28 and 28.1 and a clamping roller 27 and 27.1. The clamping roller 27.1 here has the task of preventing displacement of the connecting element 4 in the opposite direction, i.e. in the upward direction on the support profile 2. This exemplary embodiment thus avoids displacement of the connecting element both in the downward direction and in the upward direction.

A further part of the present invention is concerned with the possibility of seat-depth adjustment. FIGS. 8–13 indicate, schematically, possible ways in which a seat depth can be adjusted.

According to FIG. 8, a seat surface 30 envelops a roller 31, it being possible, for example, for the seat surface 30 to consist of textile material. If the seat surface 30 is pulled, for example counter to the force of a tension element, then a part of the surface which has hitherto been located in the seat is pulled out and can serve as a seat surface.

According to FIG. 9, the seat surface 30 could also be wound up onto a roller 31.1 at one end, in which case it would be possible for this roller to be subjected to prestressing, as a result of which the seat surface 30 is held taut.

According to FIG. 10, a seat surface 30 (not shown specifically), for example according to the exemplary embodiment of FIG. 9, could have a lamellar pull-out mechanism 32 arranged beneath it. The lamellar pull-out mechanism 32 is configured such that individual lamellae can be displaced telescopically in relation to other lamellae.

According to FIGS. 11 and 12, similar extension of the seat surface 30 is achieved by means of toggle levers 33 and scissors mechanisms 34, respectively.

In a straightforward exemplary embodiment of the invention according to FIG. 13, it is sufficient if the seat surface comprises a plurality of seat-surface elements 35.1 to 35.2 which may be connected to one another.

FIG. 14, furthermore, illustrates chairs in which a normal backrest 3 has a further backrest 36 arranged in relation to it. This additional backrest 36 can be adjusted along the seat 5, with the result that it is possible to adapt a seat depth to an individual. This can take place, in one instance, by the backrest 36 being plugged into mounts 37 arranged at different positions. However, stepless adjustment is also conceivable, in which case an appropriate slot-like recess 38 is formed in the seat. An appropriate mechanism for adjusting the backrest 36 is not shown specifically here.

What is claimed is:

1. A chair comprises at least one foot; a support profile supported on the at least one foot; a connecting element between the support profile and the seat, the connecting element comprises (a) height securing means for adjusting in a stepless manner the seat height of the support profile wherein the adjustment means includes a movable adjusting catch, and (b) seat articulating means for articulating the seat with respect to the connecting element, wherein the seat is provided with a rear covering on a back surface thereof and an edge on a bottom surface thereof, and wherein the rear covering presses onto the support profile and the edge engages behind the movable adjusting catch when the seat is in a use position.

2. The chair as claimed in claim 1, including;

a seat supported on the support profile, the seat having a front peripheral edge spaced from the support profile; and a means for changing the spacing between the support profile and the front peripheral edge of the seat.

3. The chair as claimed in claim 2, wherein the means for changing comprises at least one telescopic element provided between the support profile and front peripheral edge of the seat.

4. The chair as claimed in claim 3, wherein the at least one telescopic element is a lamellar pull-out mechanism.

5. The chair as claimed in claim 3, wherein the at least one telescopic element has at least one toggle lever.

6. The chair as claimed in claim 3, wherein the at least one telescopic element has at least one scissors element.

7. The chair as claimed in claim 1, wherein the seat has a seat surface which can be rolled up at least in part.

8. The chair as claimed in claim 1, wherein the seat has a seat surface which comprises a plurality of supplemental parts.

* * * * *